United States Patent [19]

Murakami

[11] Patent Number: 4,526,477

[45] Date of Patent: Jul. 2, 1985

[54] PIEZOELECTRIC BUZZER FOR WRIST WATCHES

[75] Inventor: Fumikazu Murakami, Tokyo, Japan

[73] Assignee: Kabushiki Kaisha Daini Seikosha, Tokyo, Japan

[21] Appl. No.: 498,694

[22] Filed: May 27, 1983

Related U.S. Application Data

[63] Continuation-in-part of Ser. No. 400,706, Jul. 22, 1982, abandoned.

[30] Foreign Application Priority Data

Jul. 23, 1981 [JP] Japan ..... 56-115489

[51] Int. Cl.[3] ..... G04C 21/16

[52] U.S. Cl. ..... 368/250; 368/255

[58] Field of Search ..... 368/72–74, 368/243, 245, 250, 251, 255

[56] References Cited

U.S. PATENT DOCUMENTS

| | | | |
|---|---|---|---|
| 3,733,804 | 5/1973 | Diersbock | 368/255 |
| 3,759,029 | 9/1973 | Komaki | 368/245 |
| 4,060,973 | 12/1977 | Martino | 368/245 |
| 4,104,865 | 8/1978 | Sasaki | 368/245 |
| 4,203,278 | 5/1980 | Kondo et al. | 368/245 |
| 4,205,517 | 6/1980 | Murakami et al. | 368/72 |
| 4,234,944 | 11/1980 | Komaki et al. | 368/245 |
| 4,370,067 | 1/1983 | Iwakura | 368/239 |

*Primary Examiner*—Vit W. Miska

*Attorney, Agent, or Firm*—Robert E. Burns; Emmanuel J. Lobato; Bruce L. Adams

[57] ABSTRACT

A piezoelectric buzzer directly secured to a portion of a wrist watch casing and driven to vibrate the casing and produce an alarm sound. Associated circuitry alternately drives the piezoelectric buzzer at two different frequencies having a frequency ratio of 4:5 and at monotonically decreasing amplitudes as to produce alarm sounds like chimes.

17 Claims, 24 Drawing Figures

PIEZOELECTRIC BUZZER FOR WRIST WATCHES

RELATED APPLICATIONS

This application is a continuation-in-part of prior application Ser. No. 400,706 filed July 22, 1982, now abandoned.

BACKGROUND OF THE INVENTION

The present invention relates to a buzzer system for wrist watches, and more particularly to a buzzer system which is capable of producing an excellent alarm sound by the use of a piezoelectric buzzer element.

The alarm function of a wrist watch is a widely provided and useful function. The requirements for an element for producing an alarm sound are small size, high efficiency and low cost. To satisfy these requirements, the arrangement for producing sound by putting a piezoelectric element directly on part of the casing of the wrist watch, such as the glass or cap, is widely used. However, if the casing of the watch is used as an element for producing sound, since various casings which differ in size or design are prepared for a timepiece module, the resonance point of the glass or the cap depends upon the respective casing. As a result, the suitable resonance point of the glass or the cap is different for every type of casing and it will sometimes occur that the sound pressure level is lowered due to the particular casing used. Moreover, it is disadvantageous that the quality of the sound produced by the use of the casing is uncomfortable.

One of the reasons why the sound is uncomfortable is that the resonance point of the casing or the cap is high and produces a sound having a high frequency component. Another reason is that since the Q-value of the vibrating body is high at its resonance point and the frequency of the free oscillation is different from that of the driving signal, and moreover the frequency ratio therebetween is not simple, the sound is discordant. In addition, for an alarm circuit in which the alarm sound is intermittently cut off in accordance with a square wave signal, at the time of the rising and falling of the signal the rapid change in frequency produces an impulsive or impact sound.

FIG. 1 is a circuit diagram of a conventional piezoelectric buzzer. In this figure, a piezoelectric element 1 and a step-up coil 2 are connected in parallel at the collector of a switching transistor 3. When an alarm signal is applied to the base 4 of the transistor 3 to turn it on or off, the current flows through the step-up coil in accordance with the conductive state of the transistor 3 and the stepped-up voltage is applied to the piezoelectric element 1. For example, when the square-wave signal shown in FIG. 2(*a*) is applied to the base 4, a voltage having the waveform shown in FIG. 2(*b*) is applied across the piezoelectric element 1.

The voltage waveform has a resonance characteristic in accordance with the time constant determined by the inductance L of the coil and the capacitance C of the piezoelectric element, and is applied to the piezoelectric element. That is, the fundamental frequency component of the alectric signal for driving the piezoelectric element is 2048 Hz when the frequency of the input signal applied to the base 4 is 2048 Hz, and higher harmonic components which are integer multiples of the fundamental frequency are included. The magnitude of the higher harmonic components depends upon the values of L and C.

Generally, it is difficult to reduce the dispersion of the inductance value of the coil in view of the method for manufacturing it. Moreover, to prevent the piezoelectric element from changing due to a temperature change, or to allow it to be incorporated into the various types of casings, the piezoelectric element configuration cannot be predetermined, so that it is impossible to maintain the capacitance value thereof constant. Therefore, it is necessary to increase the manufacturing cost so as to keep the L-C resonance point constant for every device.

In the circuit shown in FIG. 1, the sound pressure level is widely changed because changes in the characteristic of the sound-producing body are superposed on the changes in the frequency components of the driving signal.

An alarm watch having a piezoelectric vibrator connected to the watch case to produce an alarm sound is disclosed in U.S. Pat. No. 3,733,804. This patent also discloses associated circuitry comprised of an oscillator circuit and a voltage multiplier for driving the piezoelectric vibrator. The alarm sound is produced at a predetermined time by controlling energization of the oscillator circuit by simply turning on the power used to energize the oscillator circuit. Similarly, the alarm sound is terminated by turning off the power applied to the oscillator circuit. No provision is made for changing the frequency of the oscillator circuit or for changing the amplitude of the oscillator output signal in a controlled manner during the course of producing the alarm sound.

U.S. Pat. No. 3,759,029 discloses an electronic timepiece with a time signalling device which does include circuitry for changing the frequency of an alarm sound. This circuitry is comprised of an oscillator circuit and a frequency divider stage comprised of a plurality of flip-flops connected in series. Consequently, the resultant ratio between possible frequencies is limited to values which are an integer multiple of two.

SUMMARY OF THE INVENTION

The present invention aims to eliminate the above-noted drawbacks, and therefore it is an object of the invention to produce an electric signal in the timepiece module effective to drive a piezoelectric element to produce a desired alarm sound, and to obtain a sufficient level of sound pressure by the use of the casing for the watch as a sound-producing body, and which will permit variation in design of the watch casing.

BRIEF DESCRIPTION OF THE DRAWINGS

FIG. 5(*b*) is a schematic block diagram of an alarm signal synthesizing circuit according to the present invention;

FIG. 5(*c*) is a timing chart of input and output signals of the fequency dividing circuit of FIG. 5(*b*);

FIG. 5(*d*) is a schematic circuit diagram of the duty ratio changing circuit of FIG. 5(*b*);

FIG. 5(*e*) is a timing chart of input and output signals of the duty ratio changing circuit;

FIG. 5(*f*) is a schematic circuit diagram of the control circuit of FIG. 5(*b*);

FIG. 7(*b*) is a part of timing chart of FIG. 7(*a*);

DETAILED DESCRIPTION OF THE PREFERRED EMBODIMENT OF THE INVENTION

The structure and the operation of the present invention will be described in conjunction with the accompanying drawing.

The device of the present invention has a circuit for synthesizing an alarm signal, a driving circuit and a piezoelectric element for producing sound, which is attached to a casing.

Figure 1:
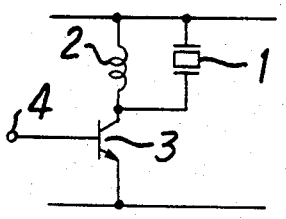
FIG. 1 is a circuit diagram of a conventional piezoelectric buzzer for wrist watches.
Figure 3A:
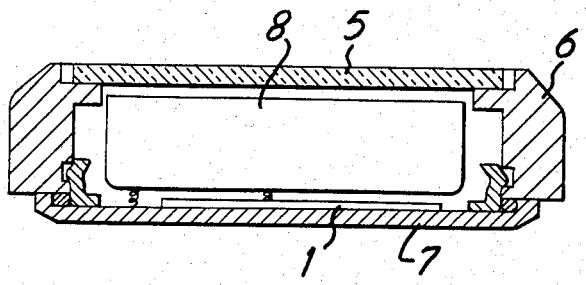
FIG. 3(*a*), 3(*b*) and 3(*c*) illustrate different ways of mounting piezoelectric buzzers for wrist watches which are used with the present invention.
Figure 2A:
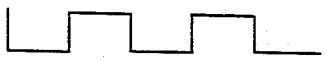
FIGS. 2(*a*) and 2(*b*) illustrate waveforms of the input signal and the output voltage of the circuit shown in FIG. 1.
Figure 3B:
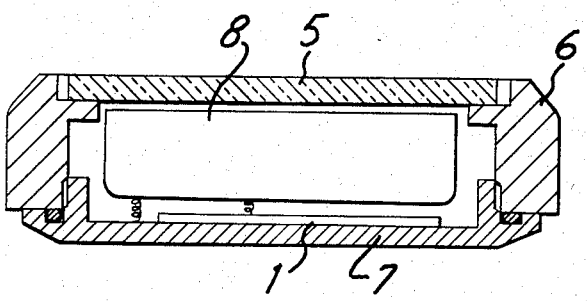
Figure 2B:
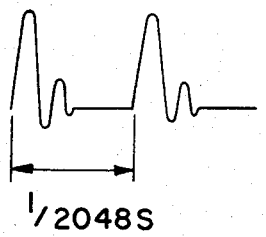
Figure 3C:
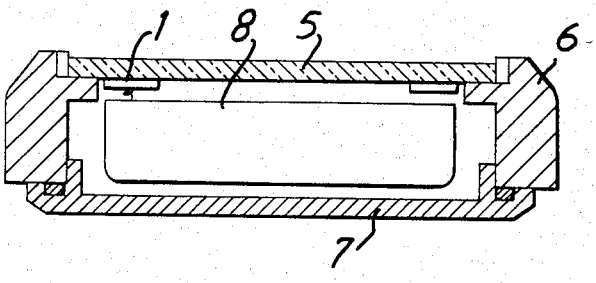

FIG. 3 shows the arrangement of the piezoelectric element or body for producing sound. FIG. 3(*a*) illustrates an example in which the piezoelectric element is secured on the cap of a relatively thin casing such as a dress type casing, FIG. 3(*b*) illustrates an example in which the piezoelectric element is secured on the cap of a relatively thick casing for a waterproof type casing and FIG. 3(*c*) illustrates an example of the piezoelectric element secured on a casing glass. In these figures, 1 is a piezoelectric element, 5 is a casing glass, 6 is a casing body, 7 is a casing cap and 8 is a timepiece module. An electronic circuit is incorporated into the timepiece module 8 and the piezoelectric element 1 vibrates by receiving an electric signal from the timepiece module.

Figure 4:
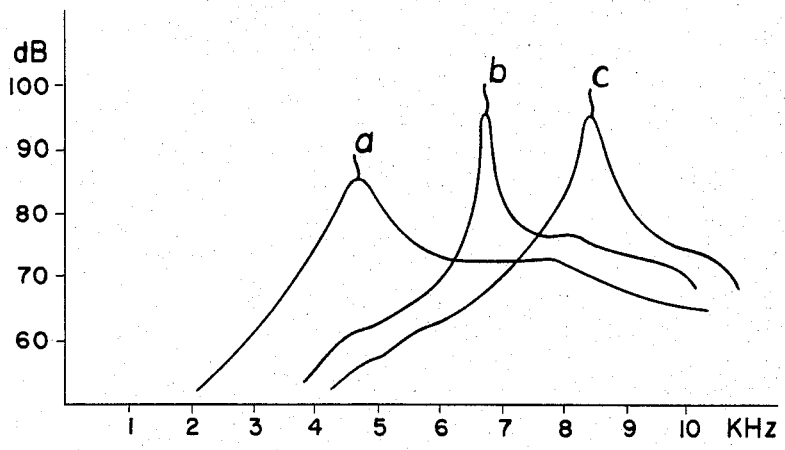
FIG. 4 illustrates characteristic curves for the different structure shown in FIGS. 3(*a*)–3(*c*)
Figure 5A:
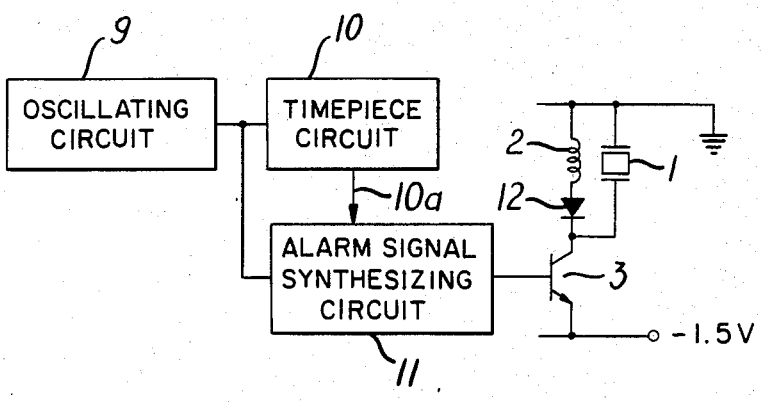
FIG. 5(*a*) is a circuit diagram of an electronic circuit of the present invention.
Figure 5B:
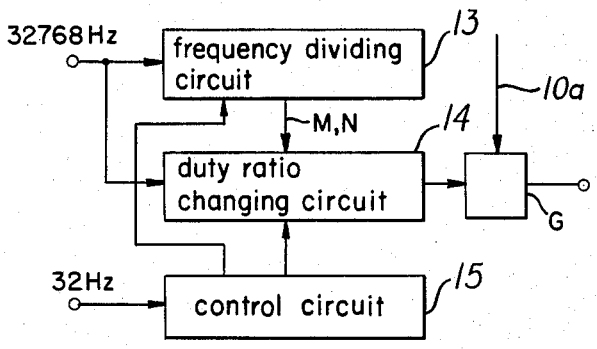
Figure 5C:
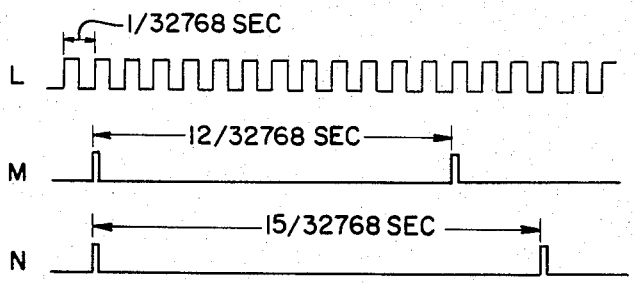
Figure 5D:
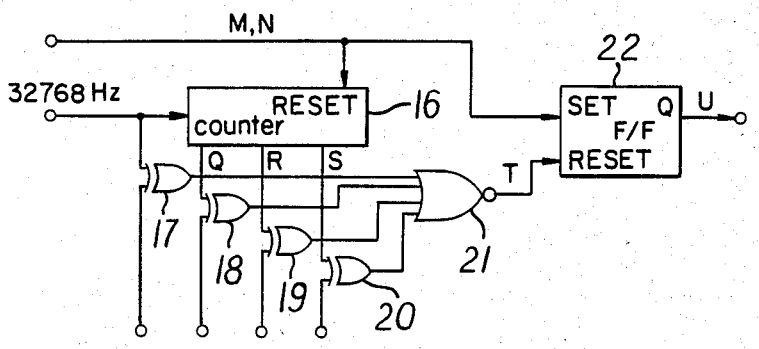
Figure 5E:
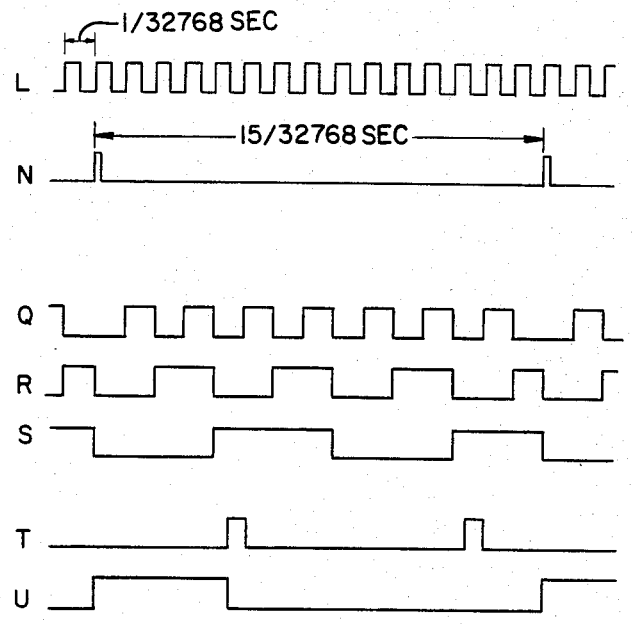
Figure 5F:
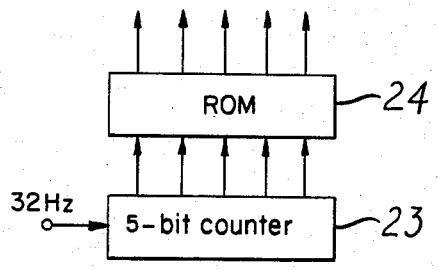
Figure 6A:
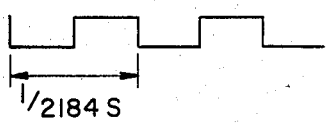
FIG. 6(*a*), 6(*b*), 6(*c*), 6(*d*) illustrate waveforms of the input signal and the output voltage of the transistor shown in FIG. 5(*a*) for explaining the operation of the circuit.
Figure 6B:
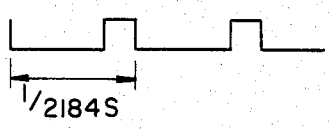
Figure 6C:
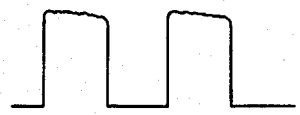
Figure 6D:
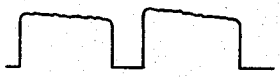

FIG. 4 illustrates the sound pressure-frequency characteristics of the body for producing sound arranged as shown in FIGS. 3(*a*)–3(*c*). The curves a, b and c of FIG. 4 show characteristics corresponding to the arrangements in FIG. 3(*a*), FIG. 3(*b*) and FIG. 3(*c*), respectively. As will be clearly seen from FIG. 4, the resonance points of the casing cap and the casing glass are approximately between 4 KHz and 10 KHz, and the level of the sound pressure becomes maximum near the resonance point. The characteristic becomes relatively flat over the frequency range higher than the resonance point because of the inertial control range. The resonance frequency depends upon the area, thickness, configuration, material and structure of the supporting portion of the casing glass or the casing cap. In the dress type watch shown in FIG. 3(*a*), the casing is not usually of the water-proof type, so that the cap 7 is thin and the pressing force of the gasket provided between the body 6 and the cap 7 is relatively small. Therefore, as shown in by curve a in FIG. 4, the resonance point frequency and the Q value at the resonance point are relatively low. FIG. 3(*b*) shows the water-proof type casing and the resonance point frequency is high due to the thick cap. In addition, most of this kind of casing have a circular configuration and the pressing force of the gasket provided between the body 6 and the cap 7 is high, so that the value of Q at the resonance point is relatively high. FIG. 3(*c*) illustrates the vibrating glass type. In general, since the glass is liable to be broken, the thickness of the glass is selected to be more than two times the thickness of the cap to maintain a higher degree of shock-proof performance. As a result, the resonance point frequency of the glass is higher than that of the cap as shown by curve c.

The sizes and characteristics of the cap, the glass and the piezoelectric vibrator are shown in the following TABLE 1.

TABLE 1

| | Diameter | Thickness | Material | Young's modules | Density |
|---|---|---|---|---|---|
| Cap a | 28 mm | 0.5 mm | Stainless Steel | $2 \times 10^{11}$ N/m$^2$ | $8 \times 10^3$ Kg/m$^3$ |
| Cap b | 28 mm | 0.7 mm | Stainless Steel | $2 \times 10^{11}$ N/m$^2$ | $8 \times 10^3$ Kg/m$^3$ |
| Glass | 28 mm | 1.5 mm | Glass | $7 \times 10^{10}$ N/m$^2$ | $2.7 \times 10^3$ Kg/m$^3$ |
| Piezoelectric element | 20 mm | 0.2 mm | | $5 \times 10^{10}$ N/m$^2$ | $7 \times 10^3$ |

As will be seen from TABLE 1, the thickness of the piezoelectric element is less than that of the cap or the glass. Therefore, the mechanical impedances of the cap and the glass are higher than that of the piezoelectric element, and the impedance of the vibrating system is mostly determined by the characteristics of the cap or the glass.

On the other hand, the driving power for vibrating the cap or the glass is produced by the piezoelectric element, and the mechanical power produced by the piezoelectric element is proportional to the supplied electrical energy. In other words, even if the piezoelectric element is varied in size or configuration, when the electrical energy supplied to the piezoelectric element is constant, the driving force transmitted to the cap or the glass is also constant. Therefore, when the piezoelectric element is driven by a circuit for applying constant electrical energy to the piezoelectric element, regardless of the capacitance value of the piezoelectric element, it is possible to provide a constant level of mechanical energy to obtain a constant sound pressure.

FIG. 5(*a*) is a circuit diagram of the present invention, which is incorporated in a timepiece module. In FIG. 5(*a*) an oscillating circuit 9 generates a time base signal with a frequency of 32768 Hz. The output signal from the oscillating circuit 9 is applied to a timepiece circuit 10 in which operations of time counting, displaying, alarm function, stop-watch function and so on are carried out. The output signal from the oscillating circuit 9 is applied to an alarm signal synthesizing circuit 11. The timepiece circuit 10 applies a control signal over circuit path 10*a* to control the alarm mode of operation.

FIG. 5(*b*) is a block diagram showing an essential portion of the alarm signal synthesizing circuit 11. Reference numeral 13 indicates a frequency dividing circuit for dividing a 32768 Hz input signal by 12 or 15. A duty ratio changing circuit 14 produces an alarm signal, whose frequency is identical to the frequency of the output signal of the frequency dividing circuit 13 and whose duty ratio changes, using the 32768 Hz signal and the output signal of the frequency dividing circuit 13. Number 15 is a control circuit for changing the frequency dividing ratio of the frequency dividing circuit 13 and the operation of the duty ratio changing circuit 14 by a 32 Hz signal every 1/32 second. An alarm start control signal from the timepiece circuit 10 and applied to a gate G over circuit path 10*a* controls the gate G to generate an alarm sound.

Now the above circuit will be described in more detail.

The frequency dividing circuit 13 is discussed briefly since it has a simple structure. A 4 bit-counter is constructed by connecting four flip-flop (referred to as F/F hereafter) stages in series. When the count content is 12 or 15, a feedback signal is applied to reset all the counters.

FIG. 5(*c*) illustrates an input signal (waveform L), an output signal (waveform M) obtained by dividing the input signal frequency by 12 and an output signal (waveform N) obtained by dividing the input signal frequency by 15 with the frequency dividing circuit 13.

The circuit structure of the duty ratio changing circuit 14 is illustrated in FIG. 5(*d*). Numeral 16 is a counter which is comprised of three F/F stages connected in series for counting a 32768 Hz signal and which is reset by the output signal from the frequency dividing circuit 13.

Numerals 17, 18, 19 and 20 are Exclusive-OR gates for comparing the 32768 Hz signal and the count outputs from the counter 16 with a control signal from the control circuit 15, and the gate outputs are applied to a NOR gate 21. The set/reset-type F/F 22 is set by the output signal from the frequency dividing circuit 13 and reset by an output from the NOR gate 21. Since the F/F 22 is constructed to give priority to a reset, the output Q is constantly kept at logical level "0" by applying a reset simultaneously with a set input.

FIG. 5(*e*) shows signal waveforms of signals developed during the operation of the duty ratio changing circuit for the case in which the frequency is 32768/15 Hz and the duty ratio is 9/30. Waveform L represents an input signal of 32768 Hz, and waveform N represents an output signal from the frequency dividing circuit 13. Waveforms Q, R and S represent output signals of the counter 16, which is reset by the signal having the waveform N. The waveform Q changes at a rising edge of the waveform L, the waveform R changes at a falling edge of the waveform Q, and the waveform S changes at a falling edge of the waveform R.

When the inputs to the gates 17, 18, 19 and 20 receive signals having logic levels "0001" respectively, applied together as a control signal to the duty ratio changing circuit 14, a signal represented by waveform T is developed as an output from the gate 21. The output from the gate 21 is at a logical level "1" twice during one period of a waveform. N to reset the F/F 22. It is a first reset pulse to change the output Q of the F/F 22. The Q output signal of the F/F 22 has the waveform U.

Other duty ratios can also be synthesized by application of control signals as shown in Table 2.

The circuit structure of the control circuit 15 is shown in FIG. 5(*f*). Numeral 23 denotes a 5-bit counter whose clock input is 32 Hz, so a count is executed every 1/32 seconds and the counter 23 restores to the original state at one second intervals. An output from the counter 23 is applied to a ROM24 having a 5-bit input and 5-bit output. One of the outputs from the the ROM24 is applied to the frequency dividing circuit 13 to set the dividing circuit output to 32768/12 Hz and 32768/15 Hz. The remaining 4-bits feed the signals shown in Table 2 to the duty ratio changing circuit 14 for controlling the duty ratio.

TABLE 2

| | | control signal | | | |
|---|---|---|---|---|---|
| Frequency | duty ratio | gate 17 input | gate 18 input | gate 19 input | gate 20 input |
| 2731 Hz | 12/24 | 1 | 0 | 1 | 1 |
| M | 10/24 | 1 | 1 | 0 | 1 |
| | 8/24 | 1 | 0 | 0 | 1 |
| | 6/24 | 1 | 1 | 1 | 0 |
| | 4/24 | 1 | 0 | 1 | 0 |
| | 2/24 | 1 | 1 | 0 | 0 |
| 2184 Hz | 15/30 | 0 | 1 | 1 | 1 |
| N | 13/30 | 0 | 0 | 1 | 1 |
| | 11/30 | 0 | 1 | 0 | 1 |
| | 9/30 | 0 | 0 | 0 | 1 |
| | 8/30 | 1 | 0 | 0 | 1 |
| | 7/30 | 0 | 1 | 1 | 0 |
| | 6/30 | 1 | 1 | 1 | 0 |
| | 5/30 | 0 | 0 | 1 | 0 |
| | 4/30 | 1 | 0 | 1 | 0 |
| | 3/30 | 0 | 1 | 0 | 0 |
| | 2/30 | 1 | 1 | 0 | 0 |

The output signal of the alarm signal synthesizing circuit 11 is applied to the base of the switching transistor 3 and the emitter of the switching transister 3 is connected to the negative terminal of a power source. The collector of the transistor 3 is connected to the power source through a diode 12 and the step-up coil 2 and is connected to the positive terminal of the power source through the piezoelectric element 1. A stepping-up/driving circuit is realized by the use of the transistor 3, the step-up coil 2, the piezoelectric element 1 and the diode 12.

The operation of the circuit having the structure described above will be described in conjunction with FIGS. 5(*a*)–5(*f*), FIGS. 6(*a*)–6(*b*) and FIGS. 7(*a*) and 7(*b*). At first, the stepping-up/driving circuit will be explained in conjunction with FIG. 5(*a*).

When a signal of 2184 Hz(=32768/15 Hz) with a duty ratio of 0.5 which is illustrated in FIG. 6(*a*) is applied to the base of the transistor 3, the voltage shown in FIG. 6(*c*) will appear across the piezoelectric element 1. Current flows through the step-up coil 2 during the conductive state of the transistor 3, and the peak value ip of the current is given by the following equation:

$$ip = \frac{E}{R}\left(1 - e^{-\frac{L}{R}t_1}\right) \quad (1)$$

wherein $t_1$ is the ON time of the transistor 3, E is the source voltage, L is the inductance of the coil 2, and R is the resistance of the coil 2.

The equation shows that the magnetic energy of $\frac{1}{2}L\,ip^2$ is accumulated in the step-up coil at the moment when the transistor 3 is rendered non-conductive. For the non-conductive state of the transistor 3, the magnetic energy is changed into electrostatic energy in accordance with the time constant determined by the electrostatic capacitance C of the piezoelectric element 1 and the inductance of the step-up coil 2 and the voltage which satisfies the following equation (2) is produced across the piezoelectric element 1.

$$\frac{1}{2}L\ ip^2 = \frac{1}{2}C\ V^2 \quad (2)$$

For the non-conductive state of the transistor 3, the voltage developed across the piezoelectric element 1 is not reduced because of the diode 12. Therefore, the output signal shown in FIG. 6(*c*) may be produced in response to the application of the input signal shown in FIG. 6(*a*). In a similar way, the output signal shown in FIG. 6(*d*) may be produced in response to the application of the input signal shown in FIG. 6(*b*). In this case, due to the low duty ratio of the input signal, the duration of the conductive state of the transistor 3 is short. As a result, the peak value of the current flowing through the step-up coil 2 becomes small and the output voltage is reduced. The waveform of the output signal is equal to the waveform obtained by inverting that of the input signal, and a square wave output signal similar thereto is applied to the piezoelectric element 1. FIG. 7(*a*) shows a diagramatical view of the output signal of the alarm signal synthesizing circuit 11.

Figure 7A:
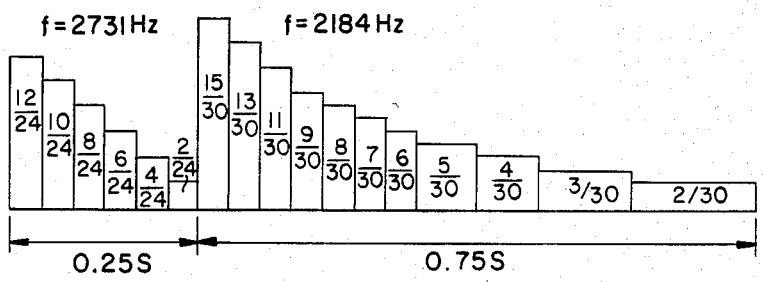
FIG. 7(*a*) is a diagrammatical view of the input signal of the present invention.
Figure 7B:
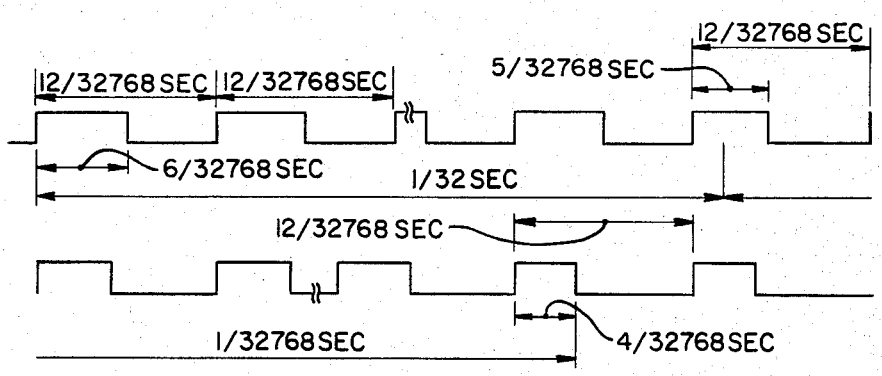

More specific signal waveforms of a primary portion of the signal shown in FIG. 7(*a*) are shown in FIG. 7(*b*). In FIG. 7(*b*), a signal at a logical level "1" for 6/32768 sec. and at a logical level "0" for 6/32768 sec. is maintained for about 1/32 sec., and then a signal of smaller duty ratio which is at a logical level "1" for 5/32768 sec. and at a logical level "0" for 7/32768 sec. is maintained for about 1/32 sec. Further a signal at a logical level "1" for 4/32768 sec. and at a logical level "0" for 8/32768 sec. is maintained for about 1/32 sec. These successive signal portions, which all have the same frequency of 32 Hz, have successively decreasing duty ratios as shown in FIGS. 7(*a* ) and 7(*b*).

Figure 8A:
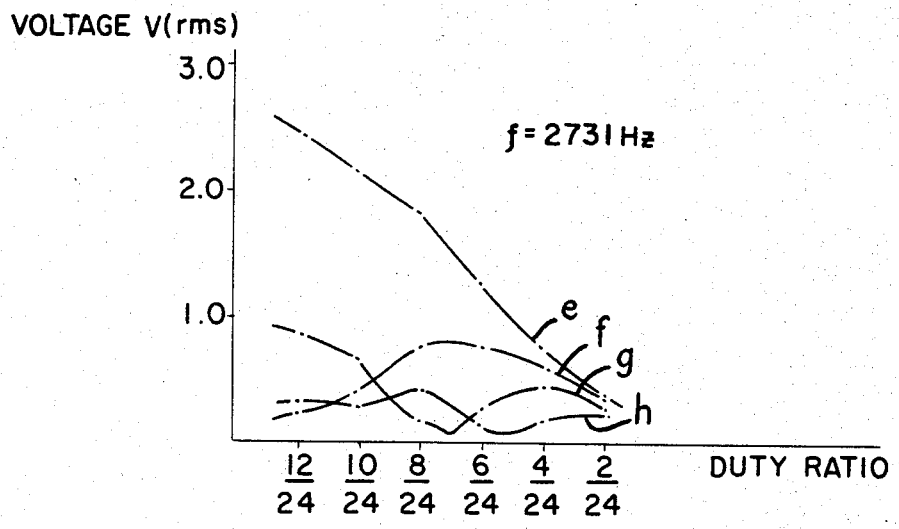
FIGS. 8(*a*) and 8(*b*) are diagrams showing frequency components in the output voltage for the input signal shown in FIG. 7(*a*)
Figure 8B:
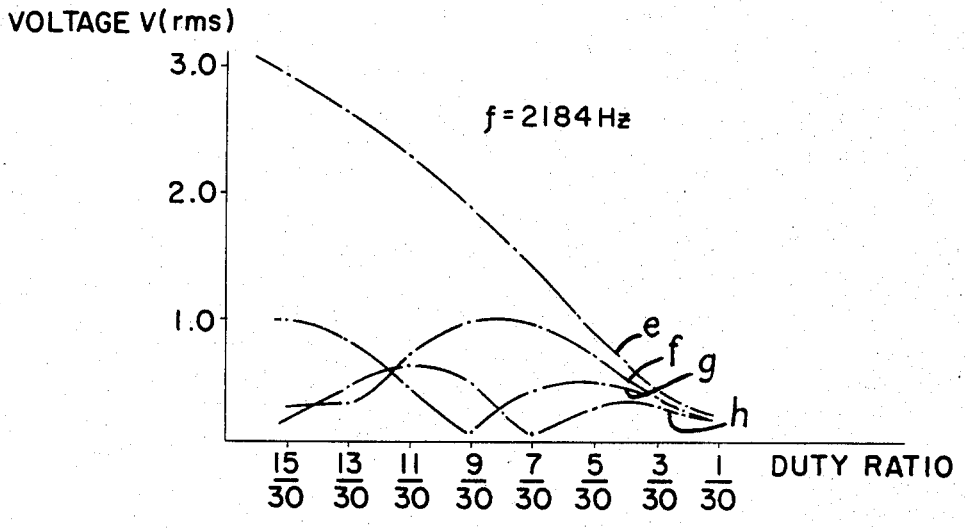

Although similar changes in the duty ratio continue accompanied by successive changes in frequency, the changes are not illustrated because of their similarity to the former ones. It is thus possible to generate a relatively clear chime sound. In FIG. 7(*a*) a signal of 32768/12 Hz (=2731 Hz) is produced for a period or interval of 0.25 seconds in the former time slot and the amplitude thereof gradually decreases. A signal of 32768/15 Hz (=2184 Hz) is produced for a period or interval of 0.75 seconds in the later time slot and the amplitude is changed as shown in the figure. The amplitude changes are brought about by changing the duty ratio of the signal applied to the transistor 3, and the duty ratio values are shown in FIG. 7(*a*). This pattern is repeated during the alarm time period. The duty ratio is 0.5 the first time, and is reduced to become $\frac{1}{3}$, $\frac{1}{4}$, . . . Such a change of the signal causes the changes in the voltage developed across the piezoelectric element 1. The changing condition is shown in FIG. 8. In FIG. 8 the horizontal axis represents a value of duty ratio and the vertical axis represents a value of voltage for every frequency component. FIG. 8(*a*) shows the case of a fundamental frequency of 2731 Hz and FIG. 8(*b*) shows the case of a fundamental frequency of 2184 Hz. In these figures, e is a voltage of the component for the fundamental wave, f is a second harmonic component, g is a third harmonic component, and h is a fourth harmonic component. The curves show measurement results for the case in which the inductance L of the step-up coil 2 is 25 mH, the resistance R is 60Ω, the electrostatic capacitance of the piezoelectric element 1 is 10 mF and the source voltage is 1.5 V.

Since the square wave voltage developed across the piezoelectric element 1 is not complete, the frequency components are not in accord with theory. However, the fundamental wave component decreases monotonically with the reduction in duty ratio and the value of the third harmonic component has a peak value at the duty ratio of $\frac{1}{2}$. The second the fourth harmonic components each has a peak value approximately at the duty ratio of $\frac{1}{3}$. It should be noted that the maximum values of the second and the third harmonic components of 2731 Hz (FIG. 8a) and the second and the third harmonic components of 2184 Hz (FIG. 8a) are approximately equal to each other. That is, the output level of the harmonic components of 4369 Hz, 5461 Hz, 6554 Hz and 8192 Hz can be set to the same value by selecting the duty ratio.

Therefore, when the signal whose duty ratio is varied as shown in FIG. 7(*a*) is used with different sound-producing bodies, even if the characteristics of the sound-producing bodies are different from each other, the sound pressure level is not lowered. Even if the resonance point of the sound-producing body is widely changed, when the change is approximately between 4 KHz and 9 KHz, the sound pressure will be substantially uniform.

Figure 9A:
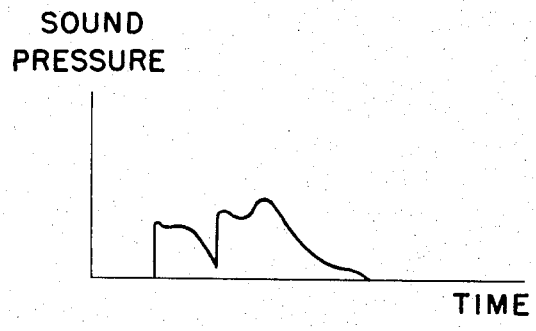
FIGS. 9(*a*), 9(*b*) and 9(*c*) illustrate waveforms of the output sound pressure of the piezoelectric buzzer according to the present invention.
Figure 9B:
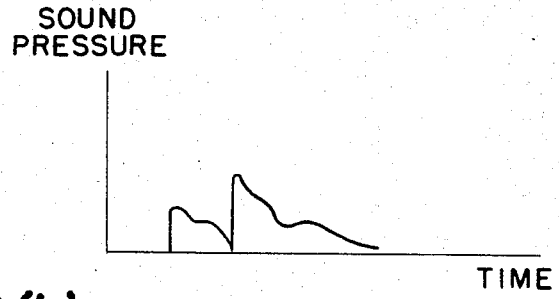
Figure 9C:
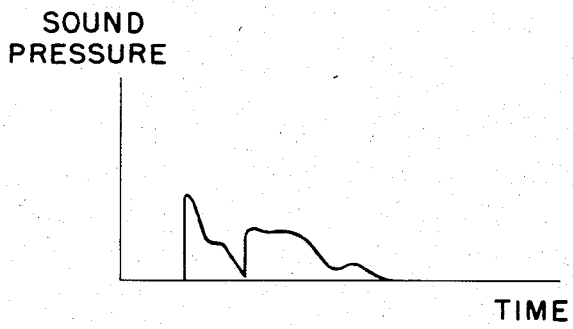

FIGS. 9(*a*)–9(*c*) illustrate the sound pressures of the chime sounds. Each curve represents a change in sound pressure over time for the sound-producing body having the characteristics shown in FIG. 4 driven by the alarm sound signal shown in FIG. 7(*a*). FIG. 9(*a*) represents the characteristics when the cap shown by curve a in FIG. 4 is driven. Since the resonance point is near 4369 Hz, the sound pressure becomes maximum when the alarm sound signal frequency is 2184 Hz with the duty ratio of 1/3. Similarly, FIG. 9(*b*) corresponds to curve b in FIG. 4 and FIG. 9(*c*) corresponds to curve c in FIG. 4. The sound pressure becomes high when the frequency component of the driving signal is near the respective resonance point.

The present invention has the structure and is operated as described above. The advantages of the present invention include the following:

The sound pressure is not reduced when the characteristics of the cap are varied for the same module.

The sound pressure level is changed only slightly even if the piezoelectric element is changed in size.

Since two fundamental frequencies are used, the harmonic frequencies will be arranged with uniform intervals.

The frequency ratio of the fundamental frequencies is 5:4 so that the chime sound has a decreasing sound pressure envelope to produce a comfortable alarm sound.

That is, according to the present invention, the various kinds of sound-producing bodies which have various resonant characteristics can be driven by the same type electronic circuit. In the sound system for a wrist watch in which the casing cap or the casing glass is used as the sound-producing body, especially, the design of the casing is not limited so that only one type of module can be used for the casing for a dress type or a waterproof type wrist watch.

Since the energy transmitted from the driving circuit to the piezoelectric element is constant, the degree of freedom in selecting the size of the piezoelectric element is increased so that the piezoelectric element can be usable for various casings. That is, when the driving force of the piezoelectric element is reduced due to small size, since the electrostatic capacity is also reduced, in accordance with the relationship shown by the equation (2) the voltage is increased, so that the sound pressure is increased to compensate for the decrease of the driving force.

Since two fundamental frequencies of 2184 Hz and 2731 Hz are selected and the respective duty ratio thereof is changed with time, a plurality of uniform harmonics thereof can be obtained. As a result, the chime sound is produced and the level of the sound pressure may be compensated.

What I claim:

1. A piezoelectric buzzer for wrist watches, comprising: a wrist watch module; a watch casing for holding said watch module; a piezoelectric element directly secured to one portion of said casing; and an electronic circuit, comprising a frequency dividing circuit for producing two output signals having a frequency ratio of 4:5, a duty ratio changing circuit for changing the duty ratios of the respective dividing circuit output signals, a control circuit for controlling said frequency dividing circuit and said duty ratio changing circuit, and a step-up driving circuit responsive to the dividing circuit output signals having duty ratios changed by the duty ratio changing circuit and having a step-up coil for developing a counter electromotive force for driving said piezoelectric element, said electronic circuit being incorporated into said watch module, and said dividing circuit output signals having duty ratios changed by the duty ratio changing circuit having two intervals the frequency of which alternately changes and being varied in duty ratio at respective intervals of time under control of the control circuit.

2. A piezoelectric buzzer for wrist watches as claimed in claim 1; wherein said piezoelectric buzzer is directly secured to a glass of the wrist watch or a cap thereof.

3. A piezoelectric buzzer for wrist watches as claimed in claim 1; wherein said step-up driving circuit includes at least a switching transistor, said step-up coil and a diode, said piezoelectric element is connected in parallel with a series circuit of said step-up coil and said diode, a collector of said transistor is connected to one terminal of said piezoelectric element, and a pair of power terminals are respectively defined by an emitter of said transistor and the other terminal of said piezoelectric element.

4. A piezoelectric buzzer for wrist watches as claimed in claim 1; wherein the frequencies of the two signals of said frequency dividing circuit are 32768/15 and 32768/12 Hz.

5. A piezoelectric buzzer for wrist watches as claimed in claim 2; wherein the frequencies of the two signals of said frequency dividing circuit are 32768/15 and 32768/12 Hz.

6. A piezoelectric buzzer for wrist watches as claimed in claim 1 wherein the change of the two signals of said frequency dividing circuit with time is repeated every predetermined time, and the duty ratio is monotonically decreased within a repetitive period and at the same frequency, thereby to produce a chime tone.

7. In a wrist watch, the combination comprising: a wristwatch casing having a casing glass portion and a casing cap portion; a piezoelectric buzzer directly secured to a portion of said casing and energizable to vibrate said casing and emit an alarm sound; a driving circuit responsive to an input signal for energizing said piezoelectric buzzer; circuit means comprised of a controllable divider circuit for producing two output signals having a frequency ratio of 4:5; a controllable duty ratio changing circuit for changing the duty ratios of the two output signals of the dividing circuit and for repetitively applying the two signals having the changed duty ratios in an alternating manner as input signals to said driving circuit; and control circuit means for applying control signals to said controllable divider circuit and to said duty ratio changing circuit for controlling the sequence and frequency of the alarm sound produced when said piezoelectric buzzer is energized.

8. In a wrist watch according to claim 7, said control circuit means comprising a counter circuit for developing a periodic sequence of output signals, and a read-only memory responsive to the periodic sequence of output signals for generating control signals applied to said controllable divider circuit and to said duty ratio changing circuit.

9. In a wrist watch according to claim 7, wherein said driving circuit is comprised of a transistor having a base receptive of the driving circuit input signal, a diode and a step-up coil connected in series with the collector-emitter path of said transistor, and said piezoelectric buzzer connected in parallel with the series combination of said diode and said step-up coil for driving said piezoelectric buzzer with a counter electromotive force developed by said step-up coil.

10. In a wrist watch according to claim 7, wherein said controllable divider circuit has means for producing two output signals having respetive frequencies of 32768/15 Hz and 32768/12 Hz.

11. In a wrist watch according to claim 7, wherein the two input signals having changed duty ratios each has successive signal portions of different duty ratios.

12. In a wrist watch according to claim 11, wherein the successive signal portions of at least one of the input signals have successively decreasing duty ratios throughout the interval of the input signal.

13. In a wrist watch according to claim 11, wherein the successive signal portions of each input signal have successively decreasing duty ratios throughout the interval of the input signal.

14. In a wrist watch according to claim 11, wherein the succesive signal portions of both input signals all have one and the same frequency.

15. In a wrist watch according to claim 11, wherein the piezoelectric buzzer is directly secured to the casing glass portion.

16. In a wrist watch according to claim 11, wherein the piezoelectric buzzer is directly secured to the casing cap portion.

17. In a wrist watch according to claim 11, wherein said controllable divider circuit has means for producing two output signals having respective frequencies of 32768/15 Hz and 32768/12 Hz.

* * * * *